US005427594A

United States Patent [19]

Lauton et al.

[11] Patent Number: 5,427,594

[45] Date of Patent: Jun. 27, 1995

[54] PROCESS FOR PICKLING RAW HIDES

[75] Inventors: Alain Lauton, Saint-Louis, France; Markus Hess, Steinen-Hofen; Günter Streicher, Weil am Rhein, both of Germany; Alois Püntener, Rheinfelden, Switzerland

[73] Assignee: Ciba-Geigy Corporation, Ardsley, N.Y.

[21] Appl. No.: 7,424

[22] Filed: Jan. 22, 1993

[30] Foreign Application Priority Data

Jan. 28, 1992 [CH] Switzerland ..... 241/92
Aug. 28, 1992 [CH] Switzerland ..... 2675/92

[51] Int. Cl.[6] ..... C14C 1/08

[52] U.S. Cl. ..... 8/94.18; 8/94.15; 8/94.17; 252/8.57

[58] Field of Search ..... 8/94.15, 94.18, 94.33, 8/94.17; 252/8.57

[56] References Cited

U.S. PATENT DOCUMENTS 4,830,632 5/1989 Lauton ..... 8/94.33

FOREIGN PATENT DOCUMENTS 18041 1/1914 France .
879525 2/1943 France .
85933 11/1894 Germany .
148898 3/1922 United Kingdom .
0683084 11/1952 United Kingdom .

OTHER PUBLICATIONS

Pektor et al. J. Amer. Leath. Chem. Ass., 55, p. 468 (1960).

*Primary Examiner*—Prince Willis, Jr.
*Assistant Examiner*—Alan D. Diamond
*Attorney, Agent, or Firm*—Kevin T. Mansfield

[57] ABSTRACT

A process for pickling raw hides, which comprises treating a delimed raw hide with an aqueous liquor that comprises a reaction product of phenol and a sulfonating agent, the molar ratio of (phenol):($SO_3$) being (1):(1.1–2.2), and which is free from neutral salts. The raw hides obtainable by the novel process are suitable for further processing by all conventional tanning methods.

16 Claims, No Drawings

PROCESS FOR PICKLING RAW HIDES

The present invention relates to a process for pickling raw hides, to a composition for the preparation of pickled raw hides as well as to the pickled material obtained by said process.

To make a hide ready for tanning, a delimed raw hide must be acidified in a pickling treatment from a pH of c. 8 to 3–4, as in neutral to weakly acid medium chrome and other mineral tannins are ineffective. Vegetable tannins are only fully effective in the acid pH range.

To acidify the raw hides it is normal practice to use sulfuric, hydrochloric or formic acid. These acids, however, induce a deleterious plumping of the collagen ("acid plumping") which is prevented by reducing the water absorption capacity of the raw hide by addition of a neutral salt, typically sodium chloride or sodium sulfate. Such acid-salt solutions, also called pickles, constitute a substantial pollution factor on account of their neutral salt containing wastewaters. There has therefore been no lack of efforts to develop pickling systems that are salt-free or of low salt content. These systems consist substantially of so-called non-plumping acids, typically phthalic acid.

A pickling process has now been found which, on the one hand, can be carried out without the addition of neutral salts and, surprisingly, on the other increases the shrinkage temperature of the hide and reduces the tanning time of a subsequent vegetable tanning.

Accordingly, the invention provides a process for pickling raw hides, which comprises treating a delimed raw hide with an aqueous liquor that comprises a reaction product of phenol and a sulfonating agent, the molar ratio of (phenol):($SO_3$) being (1):(1.1–2.2), and which is free from neutral salts.

The preferred sulfonating agent for obtaining the novel reaction product is $SO_3$ or, most preferably, oleum. Oleum is a solution of $SO_3$ in concentrated sulfuric acid. Hence particularly suitable reaction products are those of phenol and oleum most preferably those in which the molar ratio of (phenol):($SO_3$) is (1):(1.4–1.8).

The reaction product of phenol and oleum used in the practice of this invention is known per se. Thus GB-A-0 683 084 discloses the preparation of reaction products of phenol and oleum which, however, are further reacted with e.g. formaldehyde and urea or thiourea and are used as tanning agents. The reaction product of the present invention is a mixture the main component of which consists of sulfonated dihydroxydiphenyl sulfones.

The reaction product used in the present invention is normally obtained in the form of the free sulfonic acid. It can, however, also be completely or partially neutralised in aqueous solution or suspension by addition of alkali. Suitable alkalies are typically aqueous sodium hydroxide, aqueous potassium hydroxide, ammonia, organic amines including ethylamine, trimethylamine, triethylamine or morpholine, or alkanolamines such as ethanolamine, diethanolamine or triethanolamine. The pH of the resultant aqueous solution of the reaction product is in the range from 0 to 10, preferably from 0 to 4.5.

The pickling process of the present invention is carried out for example by washing the delimed raw hide with water at room temperature, preferably in the temperature range from 20° to 30° C., for 10 to 20 minutes, and thereafter treating the washed hide in an aqueous pickling liquor which contains the reaction product in a concentration of 3 to 5% by weight, based on the weight of the goods. The pH of the pickling liquor is in the range from 3 to 4. The pickling treatment is carded out at room temperature, preferably in the temperature range from 20° to 30° C., most preferably from 20° to 25° C. The treatment is carried out in a rotating drum or a winch beck.

Besides the reaction product, a $C_1$–$C_3$carboxylic acid or a mineral acid is added in the novel process as optional component to the pickling liquor in an amount of 0 to 1% by weight. Typical examples of such carboxylic acids are formic acid, acetic acid or propionic acid, and exemplary mineral acids are hydrochloric acid or sulfuric acid. It is preferred to use formic acid or sulfuric acid in the novel process. If in this preferred embodiment of the inventive process the pickling liquor additionally comprises a $C_1$–$C_3$carboxylic acid or a mineral acid, then the procedure is such that the hide is treated for 15 minutes in an aqueous liquor that contains half of the above indicated concentration of the reaction product. After this step, the second half of the reaction product is added to the pickling liquor as well as 0.1 to 1% by weight of the $C_1$–$C_3$carboxylic acid or mineral acid, and treatment is carried out for a further 90 to 180 minutes. The pH is in the range from 3.0 to 3.5.

It is not necessary to add further ingredients to the pickling liquor.

The raw hide pickled by the process of this invention is suitable for further processing, i.e. for pretanning or tanning. The novel process can be combined with all conventional tanning methods, including mineral tanning, synthetic or vegetable tanning, in which last mentioned method the tanning times can be shortened.

Raw hides suitable for use in the practice of this invention are all animal hides which can be further processed to leather.

The invention further relates to a composition for the preparation of pickled raw hides, which composition comprises (a) 1 to 10% by weight, preferably 2 to 5% by weight, of a reaction product of phenol and a sulfonating agent, the molar ratio of (phenol):($SO_3$) being (1):(1.1–2.2), (b) 0 to 1% by weight, preferably 0 to 0.5 % by weight, of a $C_1$–$C_3$carboxylic acid or a mineral acid, and (c) 89 to 99% by weight of water.

It is preferred to use a composition wherein component (a) is a reaction product of phenol and a sulfonating agent, the molar ratio of (phenol):($SO_3$) being (1):(1.4–1.8).

Further preferred compositions comprise (a) 1 to 10% by weight, preferably 2 to 5% by weight, of a reaction product of phenol and a sulfonating agent, the molar ratio of (phenol):($SO_3$) being (1):(1.1–2.2), (b) 0.1 to 1% by weight, preferably 0.1 to 0.5% by weight, of a $C_1$–$C_3$carboxylic acid or a mineral acid, and (c) 89 to 98.9% by weight of water.

It is preferred to use formic acid as component (b).

The novel composition additionally comprises 0 to 5% by weight, preferably 0 to 2% by weight, of sulfuric acid which originates from the preparation of component (a).

In the following Working and Application Examples, parts and percentages are by weight.

Unless otherwise indicated, the percentages refer to the weight of the raw hide.

EXAMPLE 1

Preparation of the reaction product 36.5 parts of phenol (1.45 mol) are fused at 45° C. To this melt are slowly added 193.4 parts of 20% oleum (2.08 mol $SO_3$) such that the temperature of the reaction mixture does not rise above 160° C. The reaction mixture is then kept, with stirring, under reduced pressure at 20 torr/160° C. for 6 hours, during which time the water of reaction is removed from the reaction mixture as an azeotrope together with minor amounts of phenol. The reaction mixture is then cooled under normal pressure to 40° C., giving 253 parts of a fused mixture the main component of which consists of sulfonic acids of formula

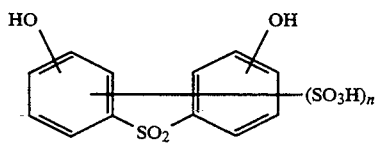

(101)

(n = 1 or 2).

Phenolsulfonic acid is additionally formed as by-product.

Application Examples

EXAMPLE 2

A delimed raw hide is washed with 200% of water for 15 minutes at 25° C. This hide is put into a pickling liquor comprising, based on the weight of the hide, 50% of water and 2% of the reaction product obtained according to Example 1.

The hide is treated for 30 minutes at 25° C. The pH of the treatment liquor is c. 3.0. To this liquor are then added 2% of the reaction product obtained according to Example 1 and 0.4% of 85% formic acid. The pH of the liquor is then 3.3–3.5. Treatment is carried out at the same temperature for 150 minutes.

The pickled raw hide so obtained is suitable for further processing.

Compared with a raw hide which has been prepared with a "traditional" pickle, the shrinkage temperature is increased by c. 10° C.

EXAMPLE 3

A delimed raw hide is washed with 200% of water for 15 minutes at 25° C. This hide is put into a pickling liquor comprising 30% of water and 3% of the reaction product obtained according to Example 1, but which has been adjusted to pH 3.5 with aqueous sodium hydroxide.

The hide is treated for 30 minutes at 25° C. The pH of the treatment liquor is c. 6.3. To this liquor is then added 0.7% of conc. sulfuric acid.

Treatment is carried out at the same temperature for 150 minutes. The pH of the pickling liquor is 3.4–3.6.

The pickled raw hide so obtained is suitable for further processing.

What is claimed is:

1. A pickling process for raw hides, which comprises treating a delimed raw hide with an aqueous liquor consisting essentially of a reaction product of phenol and a sulfonating agent, the molar ratio of (phenol):-($SO_3$) being (1):(1.1–2.2), the main component of which consists essentially of a sulfonated dihydroxydiphenylsulfone, and which is free from neutral salts.

2. A process according to claim 1, wherein the molar ratio of (phenol):($SO_3$) in the reaction product is (1):(1.4–1.8).

3. A process according to claim 1, wherein the reaction product is a mixture consisting essentially of a sulfonated dihydroxydiphenyl sulfone as main component and which has been adjusted to pH 0 to 10, by addition of alkali.

4. A process according to claim 3, wherein the reaction product is a mixture which consists essentially of a sulfonated dihydroxydiphenyl sulfone as main component and which has been adjusted to pH 0 to 4.5 by addition of alkali.

5. A process according to claim 1, wherein the aqueous liquor contains the reaction product in a concentration of 1 to 10% by weight, based on the weight of the hide.

6. A process according to claim 1, wherein the pickling treatment is carried out in the pH range from 3 to 4.

7. A process according to claim 1, wherein the pickling treatment is carried out in the temperature range from 20° to 30° C.

8. A process according to claim 1, wherein the treatment time is from 90 to 180 minutes.

9. A process according to claim 1, wherein the pickling liquor comprises a $C_1$–$C_3$carboxylic acid or a mineral acid as optional component.

10. A process according to claim 9, wherein the liquor contains the $C_1$–$C_3$carboxylic acid or the mineral acid in a concentration of 0 to 1% by weight.

11. A process according to claim 9, wherein the $C_1$–$C_3$carboxylic acid is formic acid.

12. A pickling composition for the preparation of pickled raw hides, which composition consists essentially of (a) 1 to 10% by weight of a reaction product of phenol and a sulfonating agent, the molar ratio of (phenol):($SO_3$) being (1):(1.1–2.2), (b) a $C_1$–$C_3$carboxylic acid or a mineral acid, and (c) 89 to 99% by weight of water, and which is free from neutral salts.

13. A composition according to claim 12, which consisting essentially of (a) 1 to 10% by weight of a reaction product of phenol and a sulfonating agent, the molar ratio of (phenol):($SO_3$) being (1):(1.1–2.2), and (b) 0.1 to 1% by weight of a $C_1$–$C_3$carboxylic acid or a mineral acid, and (c) 89 to 98.9% by weight of water.

14. A composition according to claim 12, wherein the molar ratio of (phenol):($SO_3$) in the reaction product is (1):(1.4–1.8).

15. A composition according to claim 13, wherein component (b) is formic acid.

16. The raw hide treated by the process as claimed in claim 1.

* * * * *